United States Patent [19]

Alten

[11] Patent Number: 4,749,018

[45] Date of Patent: Jun. 7, 1988

[54] SECTIONAL DOOR FOR BUILDINGS AND THE LIKE

[76] Inventor: Kurt Alten, Ringstr. 14, D-3015, Wennigsen, Fed. Rep. of Germany

[21] Appl. No.: 928,426

[22] Filed: Nov. 7, 1986

[30] Foreign Application Priority Data

Nov. 8, 1985 [DE] Fed. Rep. of Germany ..... 3539660

[51] Int. Cl.[4] ..... E06B 9/00

[52] U.S. Cl. ..... 160/229.1; 160/228; 16/254

[58] Field of Search ..... 160/229 R, 223, 224, 160/228, 236; 16/243, 248, 249, 254

[56] References Cited

U.S. PATENT DOCUMENTS 2,207,836 7/1940 Sundell ..... 16/254
2,882,564 4/1959 Couse et al. ..... 160/229 R
3,063,105 11/1962 Hollands ..... 160/229 R

FOREIGN PATENT DOCUMENTS 3015354 1/1981 Fed. Rep. of Germany ..... 16/254
1040170 10/1953 France ..... 160/229 R

*Primary Examiner*—Ramon S. Britts
*Assistant Examiner*—Blair M. Johnson
*Attorney, Agent, or Firm*—Becker & Becker, Inc.

[57] ABSTRACT

A sectional door, for buildings and the like, includes panel-like sections that are hingedly or pivotably connected to one another. The hinge joints that provide the pivotal connection have securing plates or brackets that extend around the pivot or hinge pin. In order to be able to effect a rapid and reliable securing of the hinge joints at any desired location along the edges of the sections, the edges of the sections that are to be connected are inventively provided with longitudinally extending slots for receiving the brackets. In addition, these edges are provided with longitudinally extending, groove-like recesses that proceed from the slots. Arresting members that cooperate with the brackets extend into the recesses. The recesses have a semicircular cross-sectional shape, and the arresting members have a spherical shape.

8 Claims, 1 Drawing Sheet

SECTIONAL DOOR FOR BUILDINGS AND THE LIKE

FIELD OF THE INVENTION

1. Background of the Invention

The present invention relates to a sectional gate or door, for buildings, having panel-like sections that are hingedly or pivotably connected to one another, with hinge joints that serve for forming the pivot connection including securing plates or brackets that hold the pivot or hinge pins.

2. Description of the Prior Art

The pivotable connection of the sections is necessary in order, when opening the door, to be able to guide these sections through a curved member into the horizontal rest position. In order, with the relatively long sections, to be able to do so without bending, it is often necessary to provide several hinge joints over the width of the door, i.e. over the length of the sections. However, mounting and securing these hinge joints becomes difficult if the sections are made of plastic panels, so that appropriately embodied hinge joint fasteners are required.

The object of the present invention is to improve the aforementioned door in such a way that it is possible to rapidly and reliably secure the hinge joints, especially at any desired point along the edges of these sections.

SUMMARY OF THE INVENTION

To realize this object, those edges of the sections that are to be connected are inventively provided with longitudinally extending slots for receiving the securing brackets, and in addition are provided with at least one groove-like recess that branches off from these slots for receiving arresting members that cooperate with the securing brackets. Advantageously, these arresting members have a spherical structure that is disposed in recesses of the securing brackets and extends beyond the latter at least toward one side in such a way that the projecting portion of the arresting members can engage in a groove-like recess.

Due to the longitudinally extending slots, the hinge joints can be shifted to any point along the sections, whereby of course if several hinge joints are to be mounted, they must be introduced successively into the slots. Since the hinge brackets have arresting members that extend into the groove-like recesses, it is not possible to pull the hinge joint off in the transverse direction once the latter has been mounted in place. Thus the hinge joints are already protected from being pulled out of the sections. It is now merely necessary to have a small securing means, for example in the form of a thin screw, to prevent the hinge joints from being shifted in the grooves.

The inventive type of hinge joint fastening is very straightforward and in addition is so reliable that the mechanical forces that occur during operation of a sectional door can be readily absorbed.

BRIEF DESCRIPTION OF THE DRAWINGS

Further particulars of the present invention will be explained with the aid of the drawing, which illustrates one exemplary specific embodiment of the present invention, and in which.

DESCRIPTION OF PREFERRED EMBODIMENTS

Figure 1:
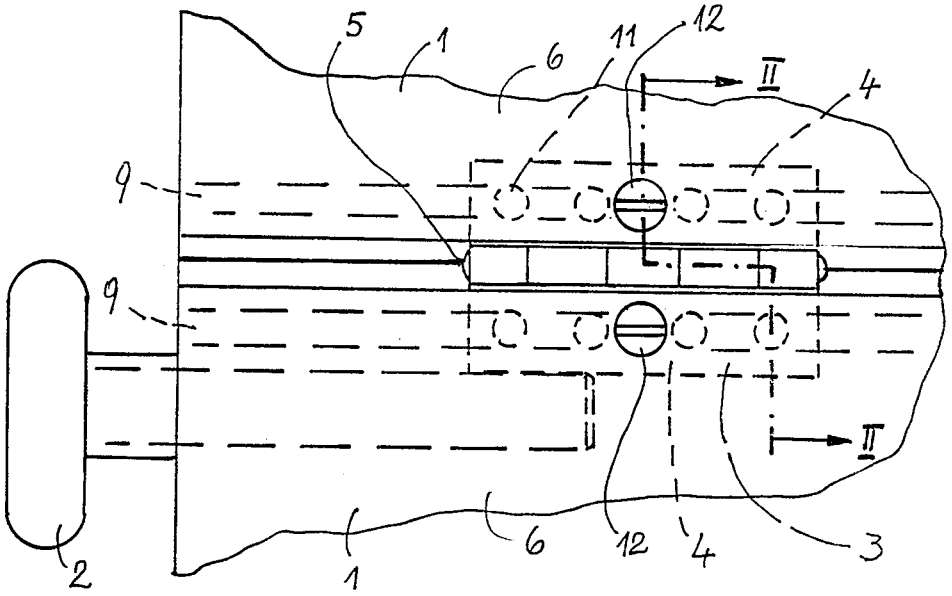
FIG. 1 is a partial view of a sectional door or gate, and in particular shows the vicinity of a hinge joint area in the edge region of two hingedly connected sections.
Figure 2:
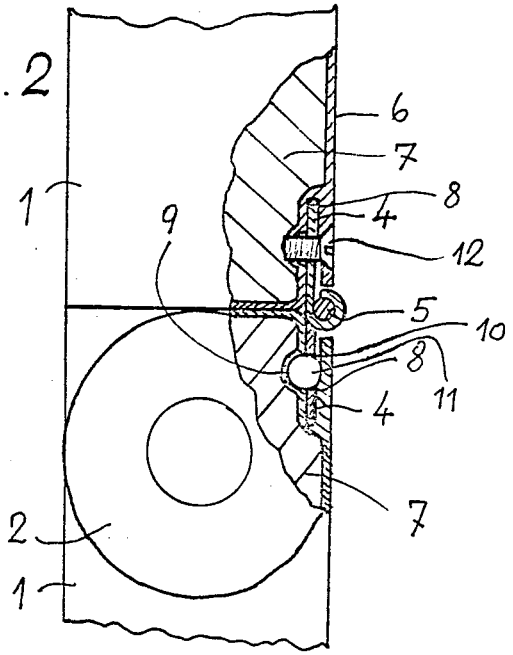
FIG. 2 is a partial cross-sectional view taken along the line II—II in FIG. 1.

The sections 1, which when viewed in elevation are rectangular, are disposed, in their operative position, i.e. in the closed state of the door, in a vertical plane. When the door is opened, all of the sections 1 are guided by laterally disposed guides into which the guide rollers 2 extend. Before the sections 1 pass into their horizontal rest position, they pass through a curved member, which is not illustrated and which necessitates a pivotal movement of the sections 1 relative to one another. For this reason, the sections 1 are provided with two or more hinge joints 3 that are distributed over the width of the door; these hinge joints connect adjacent sections 1.

In a customary manner, the hinge joints 3 comprise laterally extending plates or brackets 4 that serve for fastening and extend around a single common hinge pin 5.

Since, for example for insulation reasons, the interior of the sections 1 comprises a foam material or the like, the sections 1 are provided with a casing or covering 6. The section core surrounded by this covering is designated by the reference numeral 7. The covering 6 is made, for example, of aluminum. On the inside thereof, where the edges of the sections 1 face one another, the coverings 6 are provided with slots 8 that proceed from these edges. These slots 8 proceed from the corners of the sections, and extend parallel to the adjacent outer surface (surface of the door). The slots 8 extend over the entire length of the sections 1, i.e. the width of the door. At about midway along the height of the slots 8, semicircular grooves 9 proceed from the slots in the direction toward the core 7; these grooves 9 similarly extend over the width of the door. At the level of these grooves, the brackets 4 are provided with circular openings 10, and in particular with a total of four such openings in each bracket 4.

If during mounting of the door, i.e. during assembly of the sections 1, the hinge joints 3 are to be mounted, the latter are provided with six balls 11. The hinge joint 3, together with the balls 11 of steel or the like, are then introduced into the slots 8, with the balls 11 passing into the grooves 9 and being adapted to be shifted along with the hinge joint 3 in order to thus be able to pass to the desired position relative to the width of the door. Since a number of hinge joints 3 are required, the latter are successively introduced. The hinge joints 3 are then fixed at the desired point by a small screw 12 in order to prevent an undesired slippage; this can occur by tapping or the like to provide threads.

The hinge joint 3 is now reliably secured. The positive connection between the brackets 4, the balls 11, and the grooves 9 is so reliable that loosening or detachment of the hinge joints is precluded.

Accordingly, the present invention has the advantage that the hinge joints 3 can be rapidly mounted and fixed to a desired spot on the sections 1. Several hinge joints 3 can be mounted, with all of the hinge joints being successively moved to the desired location by being slid.

It is particularly advantageous to use the balls 11 as arresting members; the balls can be moved in the grooves 9 with practically no friction, and without having to fear twisting or the like.

The reliability achieved with the grooves 9 and the arresting members that engage therein presupposes a small amount of play between the elements. This is readily possible by suitable dimensioning, and in particular also by the edge profile of the sections 1.

The present invention is, of course, in no way restricted to the specific disclosure of the specification and drawing, but also encompasses any modifications within the scope of the appended claims.

I claim:

1. In a sectional door, for buildings, having panel-like sections that are pivotably connected to one another via hinge joints which respectively have brackets that extend around a hinge pin and also serve for fastening of that hinge joint to sections of said door, the improvement therewith which comprises:

adjacent edges of sections that are to be connected to one another each being provided with a longitudinally extending slot for receiving said brackets; said edges are also provided with longitudinally extending, groove-like curved recesses that proceed from said slots having a longitudinal direction; and arresting members that cooperate with although being independent of said brackets extending into said recesses, said curved arresting members being slidably installed in said slots along the longitudinal direction thereof in a manner to secure against withdrawal transverse to longitudinal direction of the slots.

2. In a sectional door, for buildings, having panel-like sections that are pivotably connected to one another via hinge joints which respectively have brackets that extend around a hinge pin and also serve for fastening of that hinge joint to sections of said door, the improvement wherein:

adjacent edges of sections that are to be connected to one another are each provided with a longitudinally extending slot for receiving said brackets; said edges are also provided with longitudinally extending, groove-like recesses that proceed from said slots, with arresting members that cooperate with said brackets extending into said recesses, said groove-like recesses have an approximately semicircular cross-sectional shape, and said arresting members have a spherical shape.

3. A sectional door according to claim 1, in which said slots are respectively disposed in a plane that is parallel to the plane of its door section.

4. A sectional door according to claim 1, in which the slots of sections that are to be connected to one another proceed from facing end faces of those sections.

5. A sectional door according to claim 1, in which each of said slots has one of said groovelike recesses, with the latter being provided in that side of said slot that faces the interior of said section.

6. A sectional door according to claim 1, which includes at least one screw for securing each bracket of a hinge joint to a door section to prevent said hinge joint from slipping.

7. A sectional door according to claim 1, in which at least two arresting members are associated with each of said brackets.

8. A sectional door according to claim 1, in which said brackets have appropriately sized openings, with said arresting members being loosely placed in said openings.

* * * * *